US006884110B1

(12) United States Patent
Bort

(10) Patent No.: US 6,884,110 B1
(45) Date of Patent: Apr. 26, 2005

(54) DEVICE FOR RETAINING A STRINGER OF ELECTRIC WIRE

(76) Inventor: Bruce Bort, 10 Kettering La., Lemont, IL (US) 60439

( * ) Notice: Subject to any disclaimer, the term of this patent is extended or adjusted under 35 U.S.C. 154(b) by 0 days.

(21) Appl. No.: 10/922,568

(22) Filed: Aug. 20, 2004

(51) Int. Cl.[7] ..... H01R 13/72

(52) U.S. Cl. ..... 439/501; 242/405.2; 242/402; 206/419; 206/420; 53/430

(58) Field of Search ..... 439/501; 242/402, 242/405.2; 206/419, 420; 312/35; 53/430

(56) References Cited

U.S. PATENT DOCUMENTS 1,655,065 A * 1/1928 Le Baron ..... 242/405.2
2,756,400 A * 7/1956 Palagiano ..... 439/509
2,984,347 A * 5/1961 Kalinchuk ..... 206/419
3,901,458 A * 8/1975 Kuncz, Jr. ..... 242/405.2
4,285,477 A * 8/1981 Oxendahl et al. ..... 242/405.2
5,024,324 A * 6/1991 Whittaker ..... 206/63.5
5,064,067 A * 11/1991 McAllister et al. ..... 206/420
5,526,931 A * 6/1996 White ..... 206/420
6,237,769 B1 * 5/2001 Collom ..... 206/419
6,802,471 B1 * 10/2004 Gambrell ..... 242/402
2001/0045485 A1 * 11/2001 Bregenzer ..... 242/405.2

* cited by examiner

*Primary Examiner*—Tho D. Ta
(74) *Attorney, Agent, or Firm*—Robert L. Marsh

(57) ABSTRACT

A device for retaining a string of Christmas lights is made from a planar panel of a suitable material such as wood, plastic, or metal. The panel has a central body with parallel opposing sides around which the wire of a stringer of lights is wrapped. Extensions at the ends of the parallel sides retain the wire from falling off the central body during storage. The device includes a handle and a recess in the handle large enough to receive a portion of an electrical connector and openings at the bottom of the recess to permit the prongs of a male electrical connector to extend therethrough and engage the slots of a female connector to thereby retain the connectors at the end of a stringer of lights to each other.

6 Claims, 1 Drawing Sheet

DEVICE FOR RETAINING A STRINGER OF ELECTRIC WIRE

The present invention is a retaining device for retaining a stringer of electric wire, such as a stringer of Christmas lights or an extension cord.

BACKGROUND OF THE INVENTION

The storage of Christmas lights from one Christmas to another is a common household problem. At the end of a Christmas holiday, Christmas decorations are taken down and placed in storage until they are again needed in the succeeding year. Among the decorations placed into storage are stringers of indoor and outdoor Christmas lights. It is common to store Christmas lights by wrapping them around any inexpensive rigid object, such as a piece of wood or a roll of newspaper. It is not uncommon that those rigid objects all have different shapes and sizes, and the inconsistencies between the various objects used to wrap Christmas lights further complicates the difficulty of storing Christmas lights. It would be desirable to provide a device for storing Christmas lights that would be inexpensive, would be stored in a minimum of space, and could be easily marketed during the Christmas season.

A typical stringer of electric lights has a length of wire with male electric connector at one end, and a female electric connector on the opposite end such that the lights can be connected end to end.

A device suitable for receiving a length of electric Christmas lights would also be suitable for retaining a length of electrical extension having male and female electric connectors at the ends thereof.

SUMMARY OF THE INVENTION

Briefly, the present invention is embodied in a device for retaining a length of electric wire having a male connector at a first end and a female electrical connector at the second end, and may or may not have a plurality of Christmas lights spaced along its length. The device is made from a panel of suitable material such as wood, plastic, or metal, the panel having first and second opposing planar surfaces that are free from protrusions that extend outward of the planar surfaces. The planar panel has a given thickness between the planar surfaces and is configured to have a central body with parallel sides around which wraps of the length of wire are receivable. The panel further includes a pair of parallel extensions perpendicular to one of the parallel sides with the extension protruding from opposite ends of one of the parallel sides for retaining the wraps of wire from falling off the ends of the parallel sides. The device also includes a handle portion and a recess in at least one of the planar surfaces, the recess sized to receive the end of one of the electrical connectors. A central opening at the bottom of the recess extends through to the opposing parallel surface and is positioned to receive the prongs of the male connector.

To use the device, the length of wire is wrapped around the parallel sides of the central body with the wrapping retained between the parallel extensions. Once the length of wire has been wrapped around the central body of the device, the electrical connectors at the ends thereof are positioned on opposite surfaces of the panel with the prongs of the male connector extending through the central opening at the bottom of the recess and into the slots of the female connector to thereby retain the ends of the electric wire to each other.

BRIEF DESCRIPTION OF THE DRAWINGS

A better understanding of the present invention will be had after a reading of the following detailed description taken in conjunction with the drawings wherein.

DETAILED DESCRIPTION OF PREFERRED EMBODIMENT

Figure 1:
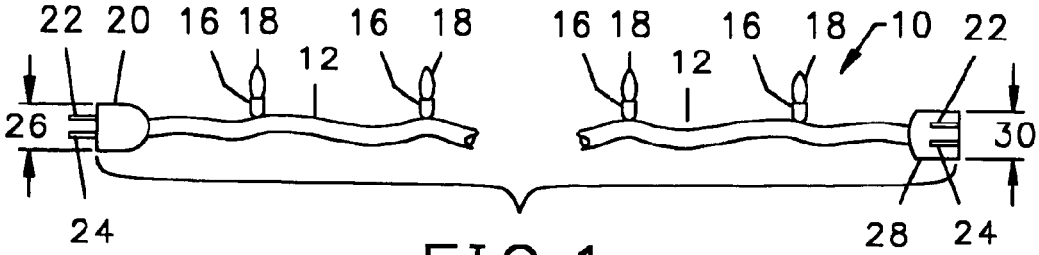
FIG. 1 is a side-elevational view of a stringer of Christmas lights having a male and female connector at the ends thereof.

Referring to FIG. 1, a typical length of Christmas lights 10 includes a twisted strand of wires 12 along which are electrically connected a plurality of sockets 16—16 and attached into each of the sockets 16—16 is a colored light 18—18. A one end of the stringer 10 is a male connector 20 having a pair of parallel prongs 22, 24 and having an outer diameter 26. At the opposite end of the stringer 10 is a female connector 28 having an outer diameter 30 and having slots 32, 34 at the distal end thereof into which the prongs of a male connector, such as the prongs 22, 24 of male connector 20 are receivable.

In accordance with the common practice, the male connector 20 of a stringer of lights 10 can be connected into a source of electric power such that the lights 18—18 in the sockets 16—16 thereof are illuminated. Thereafter, the male connector 20 of a second stringer of lights 10 can be connected into the female connector 28 of the first stringer to illuminate the lights 18—18 of the second stringer. In similar fashion, a third and fourth stringer, not shown, can be connected to the first and second stringers for providing a stringer of colored lights with an undetermined length. Typically, a stringer 10 has between 50 and 200 lights 18—18 positioned along the length thereof, with the lights spaced six to eight inches apart such that the overall length of the stringer 10 may range from twenty-five feet to one hundred and fifty feet.

Figure 2:
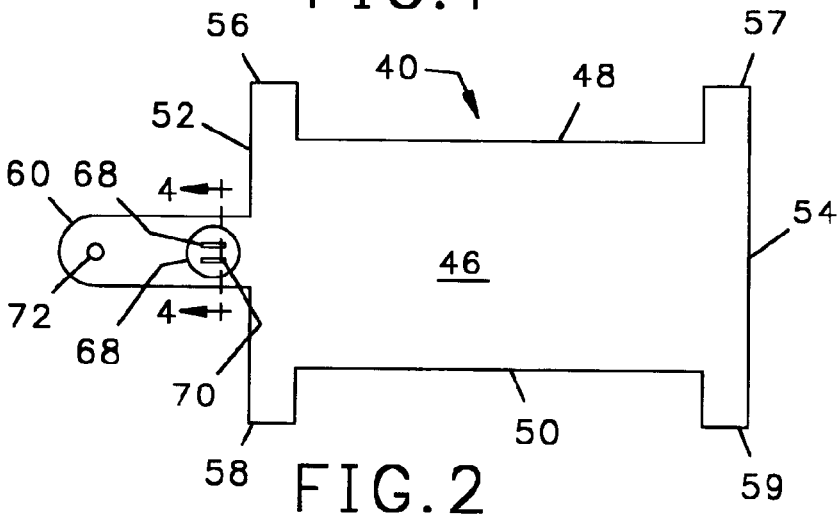
FIG. 2 is a front elevational view of a device in accordance with the present invention for receiving the wires shown in FIG. 1.
Figure 3:
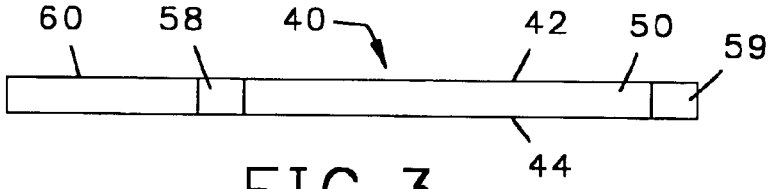
FIG. 3 is a side-elevational view of the device shown in FIG. 2.
Figure 4:
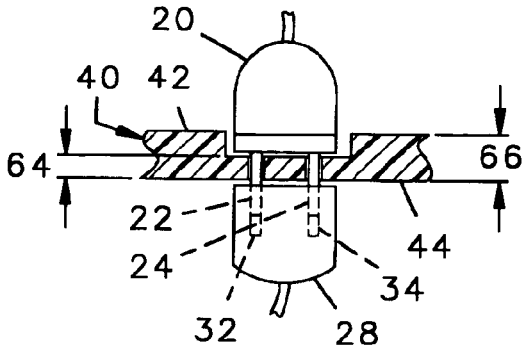
FIG. 4 is a fragmentary enlarged cross-sectional view of the device shown in FIG. 2 taken through lines 4—4 of FIG. 2.

Referring to FIGS. 2 through 4, to retain the stringer of lights 10 a device 40 in accordance with the present invention is provided. The device is made of a suitable rigid material, such as wood, plastic, or metal and has first and second opposing planar surfaces 42, 44. As can be seen in FIGS. 3 and 4, the planar surfaces 42, 44 are free from any protrusions which would interrupt the planar surface such that a plurality of devices 40 may be stacked with the planar surfaces 42, 44 of one abutting the planar surface of others to thereby minimize the space needed for the storage of a plurality of the devices 40.

The device 40 has a generally rectangular central body 46 defined by a first pair of parallel sides 48, 50 and a second pair of parallel sides 52, 54 extending perpendicular to parallel sides 48, 50. Extending parallel to the second parallel sides 52, 54 and at opposite ends of side 48 is a first pair of spaced, elongate extensions 56, 57. Similarly, extending parallel to parallel side 52, 54 and on opposite ends of side 50 are elongate extensions 58, 59. Also extending from sides 52 and generally parallel to sides 48, 50 is an elongate handle 60.

Positioned on a portion of surface 42 at the base of the handle 60 is a circular recess 62 extending into the body of the device 40 such that the thickness 64 at the bottom of the recess 62 is smaller than the spacing 66 between the opposing parallel surfaces 42, 44. Positioned at the bottom of the recess 62 are a pair of spaced holes 68, 70 having outer dimensions sufficiently large to permit the prongs 22, 24 of the male connector 20 of the stringer 10 to extend therethrough. The recess 62 also has an outer diameter that is greater than the outermost diameters 26, 30 of the distal ends of the male and female connectors 20, 28. Preferably, the thickness 64 at the bottom of the recess is no more than one-eighth inch such that the greater part of the length of the prongs 22, 24 of a typical male connector 20 can extend into the recesses 32, 34 of a female connector to retain the male and female connectors to each other as shown in FIG. 4.

The device 40 may also provide a hole 72 at the distal end of the handle 60 for retaining the device on a hook or the like should it be desirable to store the device with a string of Christmas lights thereon in a hanging configuration.

To store the stringer of lights 10 on the device 40 the central portions of the wires 12, 14 are wrapped around the parallel sides 48, 50 and between the extensions 56–59 such that the extensions 56, 59 will retain the wraps of wire from falling off the parallel sides 48, 50. Once the length of wires 12, 14 are wrapped around the sides 48, 50, the prongs 22, 24 of the male connector 20 are extended through the holes 68, 70 at the bottom of the recess 62. The female connector 28 is positioned against the opposite surface 44 and positioned such that the slots 32, 34 receive the prongs 22, 24 of the male connector 20 and coming in engagement with the prongs 22, 24 to retain the connectors 20, 28 to each other. With the male connectors retained to each other on opposite surfaces 42, 44 of the device 40, the stringer 10 will be retained to the device 40 for storage.

It is desirable that the thickness 64 at the bottom of the recess 62 be no more than one-eighth inch to ensure that the prongs 22, 24 will be adequately secured within the slots 32, 34 of the female connector 28 to thereby retain the parts together. In this regard, it should be appreciated that the prongs 22, 24 of a male connector 20 used in the United States are about five-eighths inch in length. The female connector 28 has a spring loaded contact surface that applies force against each of the prongs to retain the prongs in the slots, but such spring loaded contact surfaces are not engaged until the prongs are inserted into the slots to a depth of about one-eighth inch. Since the prongs 22, 24 must extend through the thickness 64 of the recess 62 before engaging the slots 32, 34, it is desirable that the thickness 64 be narrow, preferably not more than one-eighth inch.

It should also be appreciated that the device 40 must have a degree of rigidity to be suitable for receiving wraps of wire 10, and the thickness 66 of the body of the device 10 is therefore determined by the physical qualities of the material from which the device is made. For wood, plastic, and most other materials suitable for forming the device 40, the thickness 66 must be more than one-eighth inch to provide the desired rigidity. The recess 62 permits the body of the device to have the thickness 66 needed to provide rigidity and permit the prongs 22, 24 to be engaged by the spring retainers of the female connector 28.

Th device 40 is simple to manufacture. Since the device 40 has planar surfaces 42, 44, except for the holes 68, 70, 72 therein and the recess 62, the device 40 may be formed from a sheet of planar material such as wood, plastic, or metal in a stamping process or the like. Furthermore, the planar surfaces 42, 44 permit the device 40 to be stacked with the surfaces 42, 44 of one abutting the surfaces 42, 44 of another thereby consuming a minimum of storage space. In similar fashion, the planar configuration of the device 40 permits a homeowner to store a plurality of such devices 40 in a minimum of storage space.

It should be appreciated that a device in accordance with the present invention may have numerous exterior configurations which would be embodied within the spirit and scope of the invention. It therefore the intent of the appended claims to cover all such modifications and variations which fall within the scope and spirit of the invention.

What is claimed is:

1. A device for retaining a length of electric wire having a male connector at one end thereof and a female connector at the opposite end thereof, the device comprising a panel having opposing first and second planar surfaces, said planar surfaces being free from protrusions, said planar surfaces separated by a given thickness, said planar panel having a central body with parallel sides around which wraps of said length of wire are receivable, said panel including a pair of parallel extensions positioned at opposite ends of one of said parallel sides, said first of said planar surfaces having a recess large enough for receiving a portion of one of said electrical connectors, and at least one opening at the bottom of said opening sized to receive prongs of said male connector.

2. The device of claim 1 wherein said panel has a second thickness through said recess and said thickness through said recess is no more than one eighth inch.

3. The device of claim 2 wherein said panel has said given thickness except through said recess and said thickness through said recess is less than said given thickness.

4. The device of claim 3 and further comprising a handle and wherein said recess is in said handle.

5. The device of claim 4 wherein said handle has a longitudinal axis parallel to said parallel sides.

6. The device of claim 5 wherein said handle has a hole in an end thereof.

* * * * *

UNITED STATES PATENT AND TRADEMARK OFFICE

CERTIFICATE OF CORRECTION

PATENT NO. : 6,884,110 B1
DATED : April 26, 2005
INVENTOR(S) : Bruce Bort

It is certified that error appears in the above-identified patent and that said Letters Patent is hereby corrected as shown below:

Column 4,
Line 39, after "said" delete "opening" and substitute -- recess --.

Signed and Sealed this

First Day of November, 2005

JON W. DUDAS
*Director of the United States Patent and Trademark Office*